US010309188B2

(12) United States Patent
Jordan, Jr.

(10) Patent No.: US 10,309,188 B2
(45) Date of Patent: Jun. 4, 2019

(54) VEE RAMP SLIPS WITH PLUG

(71) Applicant: Advanced Frac Systems LLC, Houston, TX (US)

(72) Inventor: Henry Joe Jordan, Jr., Willis, TX (US)

(73) Assignee: Advanced Frac Systems LLC, Houston, TX (US)

( * ) Notice: Subject to any disclaimer, the term of this patent is extended or adjusted under 35 U.S.C. 154(b) by 132 days.

(21) Appl. No.: 15/427,250

(22) Filed: Feb. 8, 2017

(65) Prior Publication Data

US 2017/0234101 A1 Aug. 17, 2017

Related U.S. Application Data

(60) Provisional application No. 62/292,425, filed on Feb. 8, 2016.

(51) Int. Cl.
*E21B 33/129* (2006.01)
*E21B 33/128* (2006.01)

(52) U.S. Cl.
CPC ..... *E21B 33/128* (2013.01); *E21B 33/129* (2013.01)

(58) Field of Classification Search
CPC ..... E21B 33/128; E21B 33/129
See application file for complete search history.

(56) References Cited

U.S. PATENT DOCUMENTS 6,446,717 B1 * 9/2002 White ..... E21B 33/1212 166/187
9,284,803 B2 * 3/2016 Stone ..... E21B 23/00
2009/0078407 A1 * 3/2009 Carro ..... E21B 33/126 166/187
2013/0240203 A1 * 9/2013 Frazier ..... E21B 33/129 166/193
2014/0020911 A1 * 1/2014 Martinez ..... E21B 23/01 166/387

* cited by examiner

*Primary Examiner* — Brad Harcourt
(74) *Attorney, Agent, or Firm* — The Kubiak Law Firm

(57) ABSTRACT

A plug is provided that includes a mandrel, a sealing element, a slip and ramp assembly, a lock ring, at least one antirotation device, and a lower ball standoff. The slip and ramp assembly have linear and radial angles allowing a mandrel wall that is thin when compared to the overall diameter of the mandrel. The sealing element is configured so that when set additional pressure from the surface increases the sealing ability of the sealing element. Antirotation devices are provided to assist in mill out. Lock ring is provided to keep the slips in their set position and a further configured so that additional downward forces increase the locking ability of lock ring. A lower ball standoff is provided so that in the event of reverse flow a ball from below is prevented from lodging within the plug and is held at the lower end of the plug were standoffs are provided to allow fluid flow around the ball.

22 Claims, 2 Drawing Sheets

VEE RAMP SLIPS WITH PLUG

CROSS-REFERENCE TO RELATED APPLICATIONS

This application claims priority to U.S. Provisional Patent Application No. 62/292,425 that was filed on Feb. 8, 2016.

BACKGROUND

In the course of producing oil and gas wells, typically after the well is drilled, the well may be completed. One way to complete a well is to divide the well into several zones and then treat each zone individually. Treating each section of the well individually may be accomplished in several ways.

One commonly used way of accessing the area to be treated is referred to as plug and perf. Generally, when plug and perf is used a perforating assembly is prepared on the surface. The perforating assembly typically consists of a plug on the lower end of the assembly, a setting tool just above the plug, and a perforating gun just above the setting tool. The assembly is then run into the wellbore to some point below the first zone that the operator desires to treat. The setting tool is then activated locking the plug into place and sealing the well below the plug against fluid flow from the surface or the well above the plug. The setting tool is then disconnected from the plug allowing the setting tool in the perforating gun to be moved to a point adjacent the first zone that the operator desires to treat. The perforating gun is then activated penetrating the casing to allow access to the first zone. The process is then repeated to allow access to each additional zone.

One of the difficulties with the plug and perf method is that the plug has very thick walls in order to support the compressive loads that are applied which allow the slips to dig into the casing wall when the slips are set. In order to immediately put the well on production after the well treatment, such as fracking, is complete operators tend to prefer plug that is a hollow throughbore that can be sealed with a ball during well treatment. The ball can then be removed by reverse flow or dissolution allowing the well to be put on production. Unfortunately, in order to meet the requirement that the plug must support the compressive loads as the slips are set, again the walls must be very thick in turn greatly reducing the diameter of the through bore through which fluid is produced. It is not uncommon for a conventional plug to have a through bore with less than half the diameter of the outer diameter of the plug.

SUMMARY

The current embodiment allows the use of a dissolvable, erodible, or composite material to be used as a plug or packer while maintaining a large bore through the internal diameter of the tool. The large internal diameter, even when using a relatively low strength material such as various polymers, dissolvable materials, erodible materials, composite material, or even soft metal such as aluminum is accomplished by distributing the load required to set the slips over a much larger area, while keeping the overall length of the plug or packer relatively short. In the event that harder and stronger material is used then the internal bore can be increased even further. For example, in a current embodiment of the plug the unset length of the packer is between 3 and 4 times the overall diameter of the packer where the thickness of a sidewall of the tool is about one fifth of the internal bore diameter. It may be understood that the actual dimensions of the tool and the various components may vary some amount while still keeping within the spirit of the invention.

DETAILED DESCRIPTION

Figure 1:
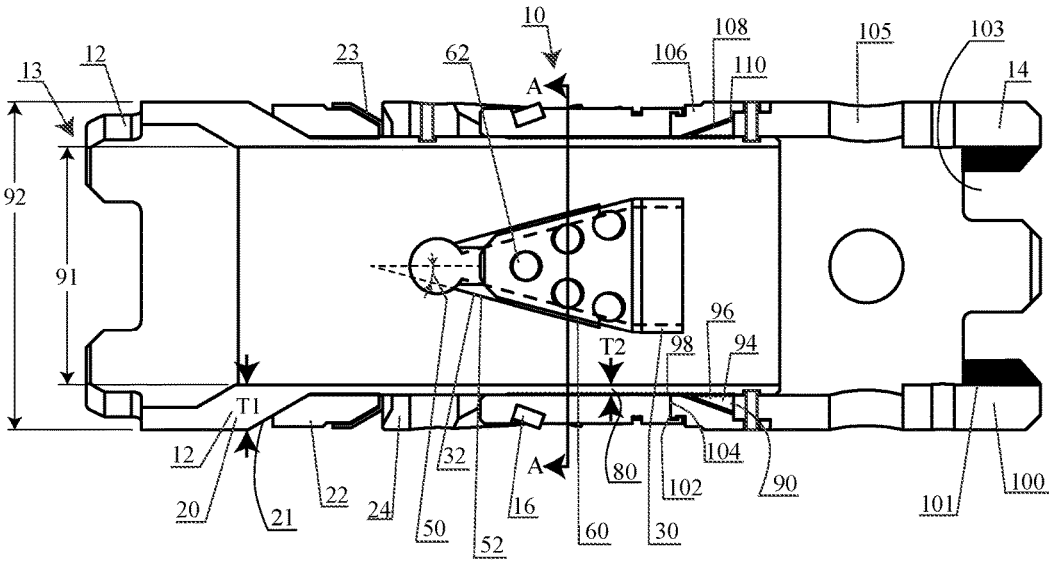
FIG. 1 depicts a cutaway side view of a vee ramp packer.

As can be seen in FIG. 1, the plug 10 has castellations 12 at the top of the tool and castellations 14 at the bottom of the plug 10. The castellations 12 are provided so that if another tool should sit down on top of the plug 10, the castellations 12 may engage with a portion of the other tool in order to prevent the other tool from rotating thereby allowing the other tool to be milled out. Similarly, castellations 14, at the lower end of the plug, are provided so that as a mill moves through the plug 10 once the mill moves through the slips 16 the remainder of the plug typically falls on top of the next lower tool or to the bottom of the well. The castellations 14 allow the remaining portion of plug 10 to engage with a portion of another tool or lower down plug in order to prevent the plug 10 from rotating during mill out. In certain versions of the plug 10 the castellations may have added elastomer 101 That does not stop a ball from moving past during pumping but the added elastomer 101 acts as a ball stop during reverse flow. The added elastomer 101 reduces the inner diameter of the plug 10 to an inner diameter less than that of a ball that may flow past the plug or has been previously introduced and is below the plug of interest. By having an inner diameter less than that of the ball that may be below the plug 10 during reverse flow the ball will move up and interact with the elastomer 101 and be prevented from flowing further upwards. However the castellations allow fluid to flow around the ball in between the openings and castellations such as opening 103 or around the tool and flow into the interior of the tool through port 105 thereby allowing the well to be produced even in the presence of an obturator or ball.

Starting from the top 13 of the mandrel 20 are the castellations 12. Moving further down the mandrel 20 is recess 23. At the upper end of recess 23 is ramp 21. Recess 23 provides an initial location within the outer diameter of mandrel 20 for the sealing element 22 and backup ring 24. The sealing element 22 is a swedgable cup type sealing element. In order to activate the sealing element 22 the plug 10 is axially compressed such that ramp 21 of the mandrel 20 and backup ring 24 moves towards one another thereby forcing the sealing element 22 radially outward on ramp 21 and into sealing engagement with the casing or wellbore wall within which the plug 10 is placed. With the sealing element 22 forced radially outward on ramp 21 a cup is formed facing the upper portion 13 of the plug 10 such that as downwards pressure from the surface is increased on the mandrel 20 of the plug 10 the sealing element 22 is forced into increasingly tighter engagement with the wellbore or casing.

As the plug 10 is axially compressed during setting the slip 30 engages with ramp 32 to move the slip 30 radially outward. Both the slip 30 and the ramp 32 have matching geometry in order to cooperate to spread the force of moving the slip 30 radially outward to engage with the casing over as large of an area of the mandrel 20 as is reasonably available. Generally, the ramp 32 is formed so that a first surface 52 is at some first angle 50 to the centerline of the plug 10 and surface 60 of slip 30 will be formed at a matching angle to that of first angle 50 of first surface 52. Preferably first angle 50 is 15° however it is been found that a first angle 50 between 10° and 30° is sufficient. Additionally, first surface 52 has a second angle 160 that is offset by a predetermined amount from the perpendicular along first angle 50. While the surface 60 of slip 30 will also have a second matching angle that matches the second angle 160 of first surface 50.

Figure 2:
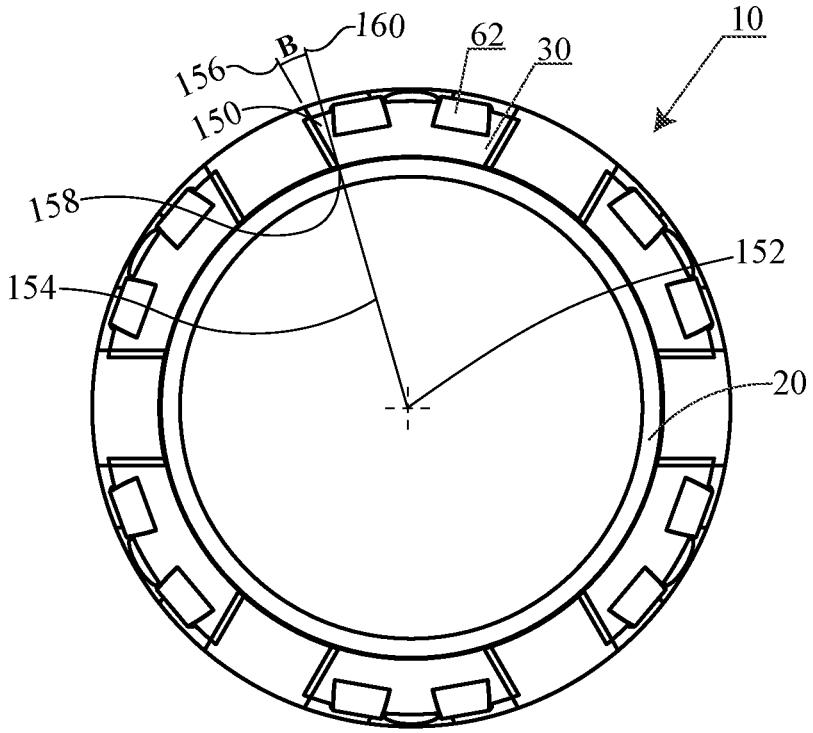
FIG. 2 depicts the cross-section A from FIG. 1 through the slips of the vee ramp packer.

The second matching angle can be more readily seen in FIG. 2 which is a cross-section of the plug 10 across section line A-A. Perpendicular line 154 is shown extending from circumferential centerpoint 152 of plug 10 radially outward through the circumference of plug 10. Perpendicular line 154 is perpendicular to the mandrel 20 at point 158. The slip 30 has an edge 150 that extends along line 156. Line 156 is set at an angle 160 to line 154. The angle 160 is the second angle of the ramp 32 and the matching second angle of slip 30. Preferably angle 160 is 15° however it is been found that an angle 160 between 10° and 30° is sufficient. An exemplary device would be a vee hull boat moving up an angled boat trailer ramp. Typically, the slip 30 will have a number of buttons 62 to engage the casing. In other instances, the slip 30 may have a number of serrations in order to engage the casing.

By using vee shaped slips and ramps the load required for the slip to engage the casing may be distributed across a larger surface area of the mandrel. As seen in FIG. 1 by distributing the load across the surface of the mandrel 20 the mandrel thickness at the slips may be reduced. In the embodiment depicted the portion of the mandrel 20 where the ramp 32 is located has a thickness 80 denoted T2 whereas the overall thickness 82 is denoted T1. T2 is generally about ¼ of the thickness of T1 although the ratio may be more or less depending upon materials and how the load of the set slip 30 is distributed across the mandrel 20 by varying both the first and second angles. The relatively small thickness 82 of the mandrel wall provides a through bore diameter 91 that is at least 70% of the overall diameter 92 of the mandrel 20. In certain versions, such as where relatively weak materials, other than steel or cast iron, such as plastics, composites, and dissolvable materials are used, the through bore diameter may be reduced to as little as 40% of the overall diameter of the mandrel.

As the plug 10 is axially compressed the lock 90 and locking ring 106 move towards the top end 13 of mandrel 20. As the lock 90 moves towards the top end 13 of the mandrel 20, serrations 96 on the interior surface 94 of lock 90 engage with serrations 98 on the exterior surface of mandrel 20. Upon the removal of the compressing force on plug 10 the lock 90 is prevented from moving towards the lower end 100 of plug 10 by the interaction between serrations 96 and serrations 98. In the event that after slip 30 is set, forces are applied that would cause slip 30 to move towards the lower end 100 of the plug 10 then shoulder 102 of slip 30 presses against shoulder 104 of lock ring 106. Lock ring 106 has angled surface 108 that interacts with angled surface 110 of lock 90 to force the serrations 96 deeper into the serrations 98 of mandrel 20 thereby preventing the lock 90 from moving towards the lower end 100 of the plug 10. With the lock 90 prevented from moving towards the lower end of plug 10 the lock ring 106 is prevented from moving towards the lower end of plug 10 and the slip 30 is held in place engaged with the casing.

With the multi angles of the ramp/slip the thickness of the mandrel can be minimized and the materials may be varied because the force of the slip setting in casing is distributed over a large surface area of the mandrel instead of over the small circumferential area allowed by a typical cone set plug.

While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A tool for downhole use comprising:

a mandrel having a ramp, wherein the ramp has a first angle and a second angle, wherein the ramp first angle is radially offset and on a plane perpendicular to a line extending radially outward from the centerline of the mandrel and the ramp second angle is between a 10 and 30 degree angle from a line extending radially outward from the centerline of the mandrel;

a slip having a first angle and a second angle, wherein the slip first angle and the slip second angle, corresponds to the ramp first angle and the ramp second angle, a sealing element circumferentially mounted on the mandrel, and a backup ring circumferentially mounted on the mandrel.

2. The tool for downhole use of claim 1 wherein, the mandrel provides a through bore diameter greater than 70% of the overall diameter of the tool.

3. The tool for downhole use of claim 1 further comprising a lock ring circumferentially mounted on the mandrel.

4. The tool for downhole use of claim 3 wherein, the lock ring is provided with serrations and the mandrel is provided with serrations, wherein the lock ring serrations and the mandrel serrations interlock.

5. The tool for downhole use of claim 1 wherein, the sealing element when axially compressed forms a cup packer.

6. The tool for downhole use of claim 1 wherein, the tool further comprises an antirotation device.

7. The tool for downhole use of claim 6 wherein, the antirotation device is a castellation.

8. The tool for downhole use of claim 1 wherein, the tool further comprises a reverse flow ball stop.

9. The tool for downhole use of claim 1 wherein, the slip first angle is about 15° to a centerline of the tool.

10. The tool for downhole use of claim 1 wherein, the slip first angle is between 10° and 30° to a centerline of the tool.

11. The tool for downhole use of claim 1 wherein, the slip second angle is circumferentially offset by 15° from a line extending radially outwards from the center of the tool.

12. A method of actuating a downhole tool comprising;

axially compressing a first end of the tool towards a second end of the tool, forcing a backup ring to move towards a sealing element, wherein the sealing element is forced radially outwards, forcing a slip having a first angle and a second angle into a slot having a corresponding first angle and second angle;

wherein the slip first angle is radially offset and on a plane perpendicular to a line extending radially outward from the centerline of the mandrel and the slip second angle is between a 10 and 30 degree angle from a line extending radially outward from the centerline of the mandrel.

13. The method of actuating a downhole tool of claim 12 wherein, the mandrel provides a through bore diameter greater than 70% of the overall diameter of the tool.

14. The method of actuating a downhole tool of claim 12 further comprising a lock ring circumferentially mounted on the mandrel.

15. The method of actuating a downhole tool of claim 14 wherein, the lock ring is provided with serrations and the mandrel is provided with serrations, wherein the lock ring serrations and the mandrel serrations interlock.

16. The method of actuating a downhole tool of claim 12 wherein, the sealing element when axially compressed forms a cup packer.

17. The method of actuating a downhole tool of claim 12 wherein, the tool further comprises an antirotation device.

18. The method of actuating a downhole tool of claim 17 wherein, the antirotation device is a castellation.

19. The method of actuating a downhole tool of claim 12 wherein, the tool further comprises a reverse flow ball stop.

20. The method of actuating a downhole tool of claim 12 wherein, the slip first angle is about 15° to a centerline of the tool.

21. The method of actuating a downhole tool of claim 12 wherein, the slip first angle is between 10° and 30° to a centerline of the tool.

22. The method of actuating a downhole tool of claim 12 wherein, the slip second angle is circumferentially offset by 15° from a line extending radially outwards from the center of the tool.

* * * * *